United States Patent [19]

Yasuoka et al.

[11] Patent Number: 4,633,839

[45] Date of Patent: Jan. 6, 1987

[54] METHOD FOR CONTROLLING THE SUPPLY OF FUEL FOR AN INTERNAL COMBUSTION ENGINE

[75] Inventors: Akimasa Yasuoka, Tokyo; Takahiro Iwata; Takeo Kiuchi, both of Asaka, all of Japan

[73] Assignee: Honda Giken Kogyo Kabushiki Kaisha, Tokyo, Japan

[21] Appl. No.: 715,294

[22] Filed: Mar. 25, 1985

[30] Foreign Application Priority Data

Mar. 28, 1984 [JP] Japan ..... 59-060087

[51] Int. Cl.[4] ..... F02B 33/00

[52] U.S. Cl. ..... 123/488; 123/494

[58] Field of Search ..... 123/494, 480, 478, 488, 123/339

[56] References Cited

U.S. PATENT DOCUMENTS

| | | | |
|---|---|---|---|
| 4,010,717 | 3/1977 | Taplin | 123/488 |
| 4,212,065 | 7/1980 | Marchak | 123/488 |
| 4,385,596 | 5/1983 | Hosaka | 123/488 |
| 4,481,929 | 11/1984 | Hasegawa | 123/488 |
| 4,502,448 | 3/1985 | Otobe | 123/494 |
| 4,513,713 | 4/1985 | Koumura | 123/494 |
| 4,549,517 | 10/1985 | Kamiyama | 123/488 |

*Primary Examiner*—Ronald B. Cox

*Attorney, Agent, or Firm*—Birch, Stewart, Kolasch & Birch

[57] ABSTRACT

A fuel supply of an internal combustion engine is controlled by sampling a vacuum level within an intake pipe of the engine and a value corresponding to the engine rotational speed at predetermined sampling intervals, subsequently correcting a latest sampled value $P_{BAn}$ of the vacuum level with a latest sampled value $M_{en}$ of the value corresponding to the engine rotational speed to produce a corrected value $P_{BA}$, and then determining fuel supply amount in accordance with the corrected value $P_{BA}$. By determining the fuel supply amount in this way, hunting of the engine rotational speed especially during idling operation of the engine is prevented.

2 Claims, 6 Drawing Figures

| FIG.4 (a) | FIG.4 (b) |
|---|---|

(a)

METHOD FOR CONTROLLING THE SUPPLY OF FUEL FOR AN INTERNAL COMBUSTION ENGINE

BACKGROUND OF THE INVENTION

1. Field of the Invention.

The present invention relates to a method for controlling the supply of fuel for an internal combustion engine.

2. Description of Background Information

Among internal combustion engines for a motor vehicle, there is a type in which fuel is supplied to the engine via a fuel injector or fuel injectors.

As an example, a system is developed in which the pressure within the intake pipe, downstream of the throttle valve, and the engine rotational speed (referred to as rpm (revolutions per minute) hereinafter) are sensed and a basic fuel injection time $T_i$ is determined according to the result of the sensing at predetermined intervals synchronized with the engine rotation. The basic fuel injection time $T_i$ is then multiplied with an increment or decrement correction co-efficient according to engine parameters such as the engine coolant temperature or in accordance with transitional change of the engine operation. In this manner, an actual fuel injection time $T_{out}$ corresponding to the required amount of fuel injection is calculated.

However, in conventional arrangements, hunting of the engine rpm tends to occur especially during idling operation of the engine if the basic fuel injection time period is determined simply according to the engine rpm and the pressure within the intake pipe of the engine detected at a time of control operation.

SUMMARY OF THE INVENTION

An object of the present invention is therefore to provide a method for controlling the fuel supply of an internal combustion engine by which the driveability of the engine is improved with the prevention of the hunting of the engine rpm during the period in which the opening angle of the throttle valve is small, such as the idling period.

According to the present invention, a fuel supply control method comprises a step for sampling the pressure within the intake pipe and a value corresponding to the engine rpm at predetermined sampling intervals, a step for deriving a corrected value of absolute pressure $P_{BA}$ by correcting a latest sampled value of the pressure within the intake pipe according to a latest sampled value $M_{en}$ of the value corresponding to the engine rpm, and a step for determining the fuel supply amount in accordance with the thus derived corrected value $P_{BA}$.

Further scope and applicability of the present invention will become apparent from the detailed description given hereinafter. However, it should be understood that the detailed description and specific examples, while indicating a preferred embodiment of the invention, are given by way of illustration only, since various change and modifications within the spirit and the scope of the invention will become apparent to those skilled in the art from this detailed description.

BRIEF DESCRIPTION OF THE DRAWINGS

FIGS. 4, 4A, and 4B are flowcharts showing an embodiment of the fuel supply control method according to the present invention.

DETAILED DESCRIPTION OF THE PREFERRED EMBODIMENT

Figure 1:
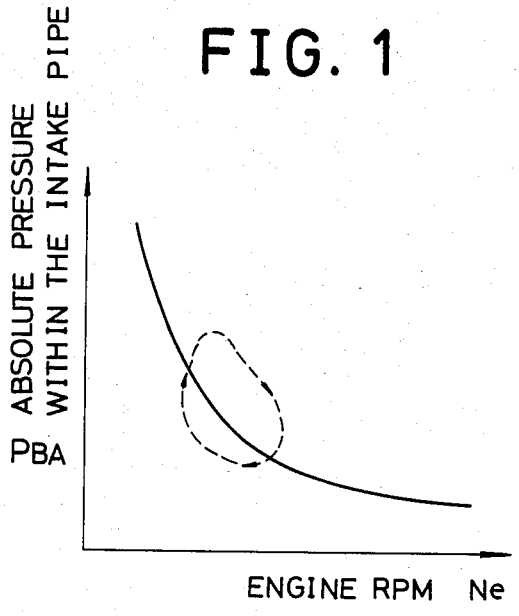
FIG. 1 is a diagram illustrating a relationship between the engine rpm and the pressure within the intake pipe of the engine.

Before entering into the explanation of the preferred embodiment of the invention, reference is first made to FIG. 1 in which the relation between the engine rpm and the absolute pressure $P_{BA}$ within the intake pipe is illustrated.

When the opening angle of the throttle valve is small and maintained almost constant, in such a period of idling operation, the relation between the engine rpm and the absolute pressure $P_{BA}$ becomes such as shown by the solid line of FIG. 1. In this state, a drop of the engine rpm immediately results in an increase of the absolute pressure $P_{BA}$. With the increase of the absolute pressure $P_{BA}$, the fuel injection time becomes long, which in turn causes an increase of the engine rpm $N_e$. On the other hand, when the engine rpm $N_e$ increases, the absolute pressure immediately decreases to shorten the fuel injection time. Thus, the engine torque is reduced to slow down the engine rpm. In this way, the engine rpm $N_e$ is stabilized.

However, the above described process holds true only when the capacity of the intake pipe is small. If the capacity of the intake pipe is large, the absolute pressure $P_{BA}$ and the engine rpm $N_e$ deviate from the solid line of FIG. 1. Specifically, if the engine rpm drops, the absolute pressure does not increase immediately. Therefore, the fuel injection time remains unchanged and the engine output torque does not increase enough to resume the engine rpm. Thus, the engine rpm $N_e$ further decreases. Thereafter, the absolute pressure $P_{BA}$ increases after a time lag and, in turn, the engine output torque increases to raise the engine rpm $N_e$.

Similarly, the decrease of the absolute pressure $P_{BA}$ relative to the increase of the engine rpm $N_e$ is delayed. With these reasons, the absolute pressure $P_{BA}$ fluctuates as illustrated by the dashed line of FIG. 1 repeatedly.

Thus, in the conventional arrangement where the basic fuel injection time is determined simply from the detected engine rpm and the absolute pressure within the intake manifold detected at a time point of the control operation, a problem of hunting of the engine rpm could not be avoided especially during the idling period of the engine.

Figure 2:
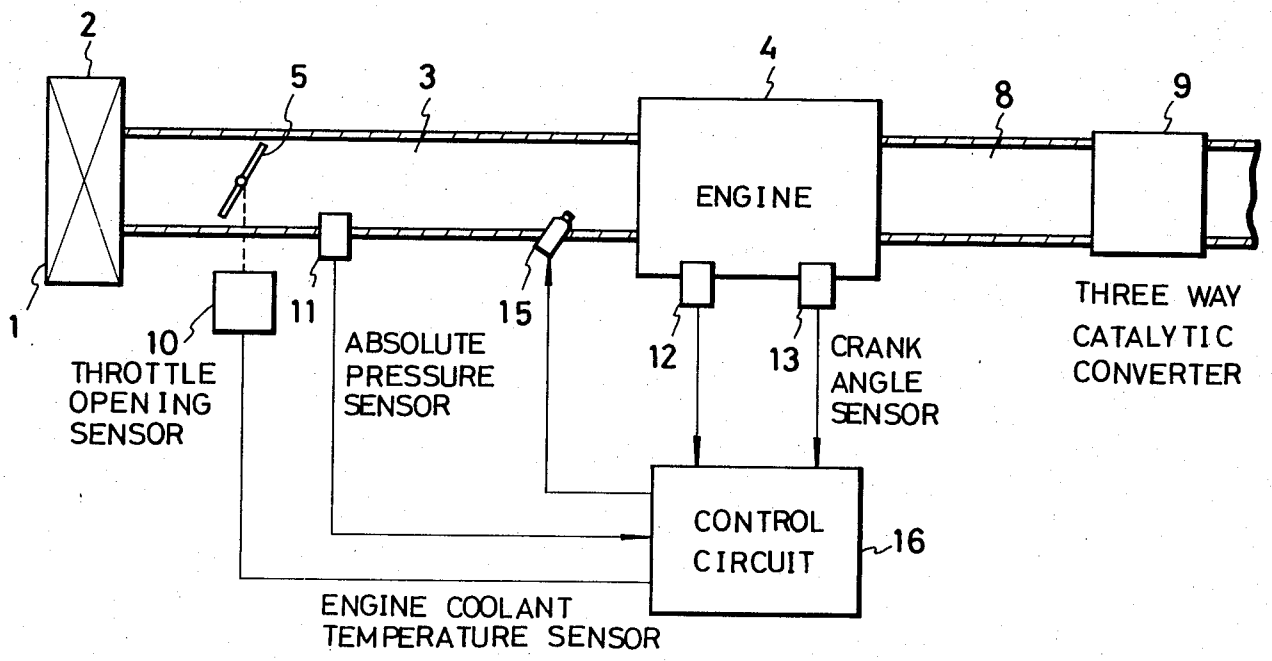
FIG. 2 is a schematic structural illustration of an electronically controlled fuel supply system in which the fuel supply control method according to the present invention is effected.

FIG. 2 is a schematic illustration of an internal combustion engine which is provided with an electronic fuel supply control system operated in accordance with the controlling method according to the present invention. In FIG. 2, the engine designated at 4 is supplied with intake air taken at an air intake port 1 and which passes through an air cleaner 2 and an intake air passage 3. A throttle valve 5 is disposed in the intake air passage 3 so that the amount of the air taken into the engine is controlled by the opening degree of the throttle valve 5. The engine 4 has an exhaust gas passage 8 with a threeway catalytic converter for promoting the reduction of noxious components such as CO, HC, and NOx in the exhaust gas of the engine.

Further, there is provided a throttle opening sensor 10, consisting of a potentiometer for example, which generates an output signal whose level corresponds to the opening degree of the throttle valve 5. Similarly, in the intake air passage 3 on the downstream side of the throttle valve 5, there is provided an absolute pressure sensor 11 which generates an output signal whose level correspondes to an absolute pressure within the intake air passage 3. The engine 4 is also provided with an engine coolant temperature sensor 12 which generates an output signal whose level corresponds to the temperature of the engine coolant, and a crank angle sensor 13 which generates pulse signals in accordance with the rotation of a crankshaft (not illustrated) of the engine. The crank angle sensor 13 is, for example, constructed so that a pulse signal is produced every 120° of revolution of the crankshaft. For supplying the fuel, an injector 15 is provided in the intake air passage 3 adjacent to each inlet valve (not shown) of the engine 4.

Output signals of the throttle opening sensor 10, the absolute pressure sensor 11, the engine coolant temperature sensor 12, the crank angle sensor 13 are connected to a control circuit 16 to which an input terminal of the fuel injector 15 is also connected.

Figure 3:
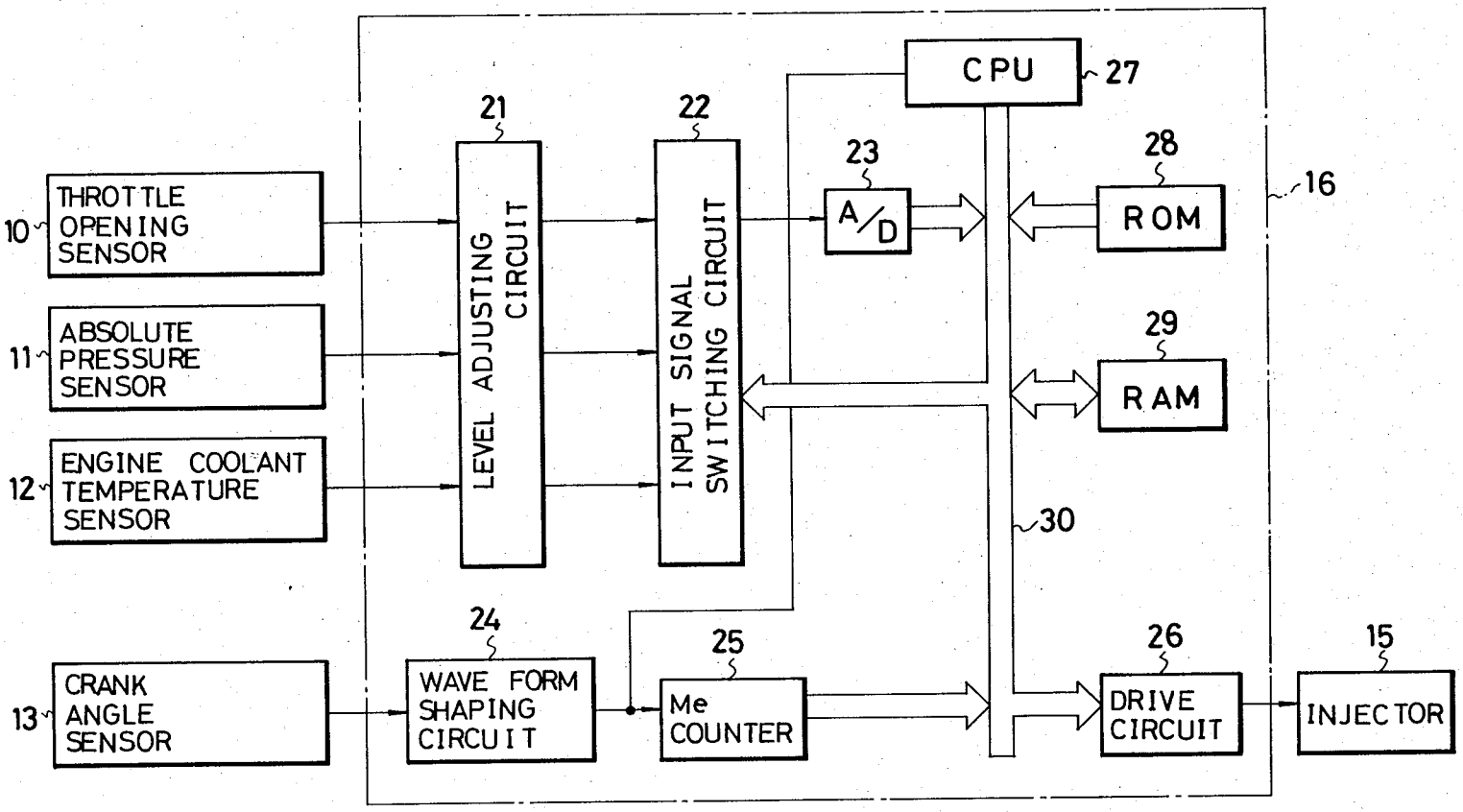
FIG. 3 is a block diagram showing a concrete circuit construction of the control circuit used in the system of FIG. 2.

Referring to FIG. 3, the construction of the control circuit 16 will be explained. The control circuit 15 includes a level adjustment circuit 21 for adjusting the level of the output signals of the throttle opening sensor 10, the absolute pressure sensor 11, the coolant temperature sensor 12. These output signals whose level is adjusted by the level adjusting circuit 21 are then applied to an input signal switching circuit 22 in which one of the input signals is selected and in turn output to an A/D (Analog to Digital) converter 23 which converts the input signal supplied in analog form to a digital signal. The output signal of the crank angle sensor 13 is applied to a waveform shaping circuit 24 which provides a TDC (Top Dead Center) signal according to the output signal of the crank angle sensor 13. A counter 25 is provided for measuring the time between each pulses of the TDC signal. The control circuit 16 further includes a drive circuit 26 for driving the injector 15, a CPU (Central Processing Unit) 27 for performing the arithmetic operation in accordance with programs stored in a ROM (Read Only Memory) 28 also provided in the control circuit 16, and a RAM 29. The input signal switching circuit 22, the A/D converter 23, the counter 25, the drive circuit 26, the CPU 27, the ROM 28, and the RAM 29 are mutually connected by means of an input/output bus 30.

With this circuit construction, information of the throttle opening degree $\theta$th, absolute value of the intake air pressure $P_{BA}$, and the engine coolant temperature $T_W$, are alternatively supplied to the CPU 27 via the input/output bus 30. From the counter 25, information of the count value $M_e$ inversely related to the number of engine revolutions $N_e$ is supplied to the CPU 27 via the input/output bus 30. In the ROM 28, various operation programs for the CPU 27 and various data are stored previously.

In accordance with this operation programs, the CPU 27 reads the above mentioned various information and calculates the fuel injection time duration of the fuel injector 15 corresponding to the amount of fuel to be supplied to the engine 4, using a predetermined calculation formulas in accordance with the information read by the CPU 27. During the thus calculated fuel injection time period, the drive circuit 26 actuates the injector 15 so that the fuel is supplied to the engine 4.

Figure 4:
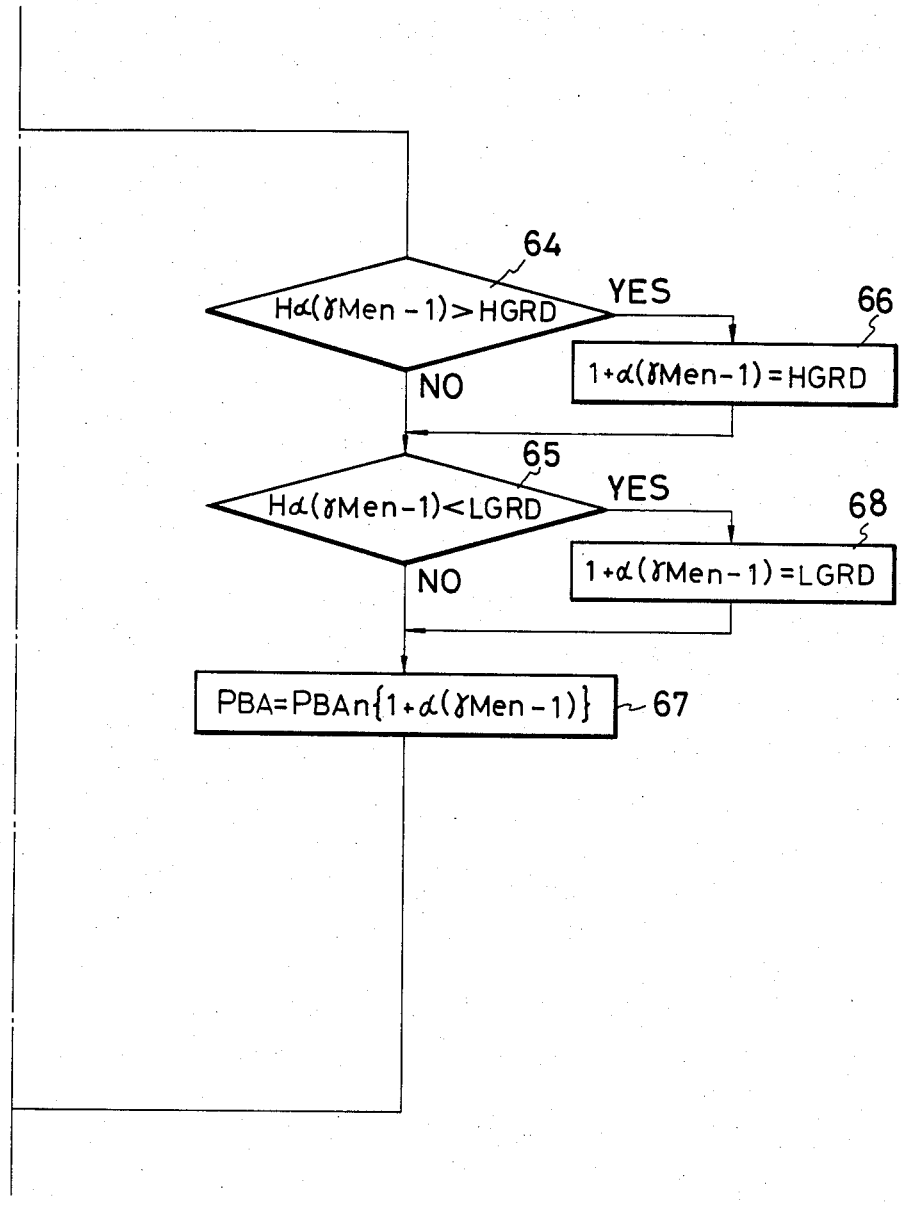
Figure 4:
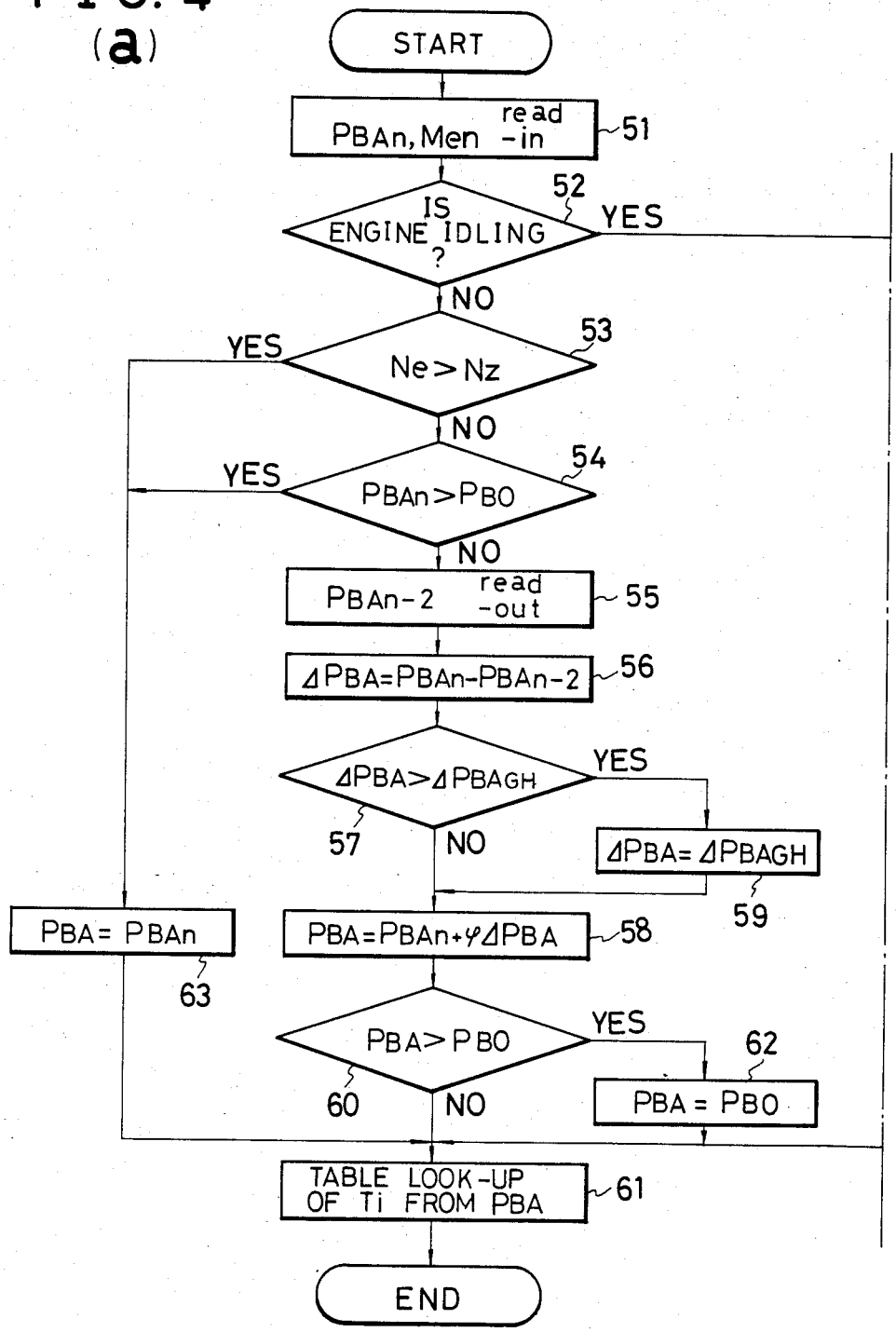

Each step of the operation of the method for controlling the supply of fuel according to the present invention, which is mainly performed by the control circuit 16, will be further explained with reference to the flowchart of FIG. 4.

In this sequencial operations, the absolute value of the intake air pressure $P_{BA}$ and the count value $M_e$ are read by the CPU 27 respectively as a sampled value $P_{BAn}$ and a sampled value $M_{en}$, in synchronism with the occurence of every (nth) TDC signal (n being an integer). These sampled values $P_{BAn}$ and $M_{en}$ are in turn stored in the RAM 29 at a step 51. Subsequently, whether the engine 4 is operating under an idling state or not is detected at a step 52. Specifically, the idling state is detected in terms of the engine coolant temperature $T_W$, the throttle opening degree 0th, and the engine rpm $N_e$ derived from the count value $M_e$.

When the engine is not operating under the idling condition, which satisfys all of the conditions that the engine coolant temperature is high, the opening degree of the throttle valve is small, and the engine rpm is low, whether the engine rpm $N_e$ is higher than a predetermined value $N_z$ or not is detected at a step 53.

If $N_e \leqq N_z$, whether or not the sampled value $P_{BAn}$ is greater than a predetermined value $P_{BO}$ ($P_{BO}$ being about atmospheric pressure value) is detected at a step 54. If $P_{BAn} \leqq P_{BO}$, a previous sampled value $P_{BAn-2}$, that is the sampled value two samples ago, is read out from the RAM 29 at a step 55. Then a subtraction value $\Delta P_{BA}$ between the latest sampled value $P_{BAn}$ and the sampled value $P_{BAn-2}$ is calculated at a step 56. The sampled values $P_{BAn}$ of the absolute value of the intake air pressure $P_{BA}$ and the sampled values $M_{en}$ of the count value $M_e$ are stored in the RAM 29, for example, for the last six cycles of sampling. At a step 57, the subtraction value $\Delta P_{BA}$ is compared with a predetermined reference value $\Delta P_{BAGH}$, corresponding to 64 mmHg for example. If $\Delta P_{BA} \leqq P_{BAGH}$, a multiplication factor $\phi$(for example, 4) is multiplied to the subtraction value $\Delta P_{BA}$ and the sampled value $P_{BAn}$ is added to the product at a step 58. Thus, the corrected value of the latest sampled value $P_{BA}$ is calculated. If $\Delta P_{BA} > \Delta P_{BAGH}$, the subtraction value $\Delta P_{BA}$ is made equal to the predetermined value $\Delta P_{BAGH}$ at a step 59 and the program goes to the step 58.

Thereafter, whether or not the corrected value $P_{BA}$ is greater than a predetermined value $P_{BO}$ is detected at a step 60. If $P_{BA} \leqq P_{BO}$, the fundamental fuel injection time duration Ti is determined in accordance with the corrected value $P_{BA}$, at a step 61, using a data map stored in ROM 28 previously. If $P_{BA} > P_{BO}$, then the corrected value $P_{BA}$ is made equal to $P_{BO}$ at a step 62 and the program goes to the step 61.

If $N_e > N_z$ at the step 53 or if $P_{BAn} > P_{BO}$ at the step 54, the latest sampled value $P_{BAn}$ is used as the corrected value $P_{BA}$ at the step 63 and afterwards, the program goes to the step 61.

On the other hand, at the step 52, if the engine is operating under the idling condition, $1+\alpha(\gamma M_{en}-1)$ then calculated and whether or not the value $1+\alpha(\gamma M_{en}-1)$ is greater than an upper limit HGRD (1.05 for example) is detected at a step 64. In these equation, $\alpha$ is a correction coefficient (0.7 for example), and $\gamma$ is $1/M_{eIDLE}$ ($M_{eIDLE}$ being an inverse number of a target idle speed).

If $1+\alpha(\gamma M_{en}-1) \leqq HGRD$, then whether or not $1+\alpha(\gamma M_{en}-1)$ is smaller or equal to a lower limit value LGRD (0.95 for example) is detected at the step 65. If $1+\alpha(\gamma M_{en}-1) > HGRD$ at the step 64, then $1+\alpha(\gamma M_{en}-1)$ is made equal to HGRD at a step 66 and then the program goes to the step 65. If $1+\alpha(\gamma M_{en}-1) \geqq LGRD$ at the step 65, then the latest sampled value $P_{BAn}$ is multiplied to $1+\alpha(\gamma M_{en}-1)$ to calculate the corrected value $P_{BA}$ of the latest sampled value $P_{BAn}$ at a step 67. If $1+\alpha(\gamma M_{en}-1) < LGRD$, then $1+\alpha(\gamma M_{en}-1)$ is made equal to LGRD at a step 68, and the program goes to the step 67. The fundamental fuel injection time duration Ti is determined from the corrected value $P_{BA}$ at the step 61.

In the fuel supply control method according to the present invention, the relation between the absolute value $P_{BA}$ of the intake air pressure and the engine rpm $N_e(N_e=1/M_e)$ shown by the solied line in FIG. 1, is expressed by the following equation (1):

$$P_{BA}=K \cdot M_e \tag{1}$$

(K being a constant)

In the idle condition of the engine, if the absolute value $P_{BA}$ of the intake air pressure does not fluctuate so much, the equation (1) will be rewritten as the following equation (2):

$$P_{BA}=P_{BAn}(1/M_{eIDLE}) \cdot M_e \tag{2}$$

However, eventually as indicated by the dashed line of FIG. 1, if the count number $M_e$ becomes small, that is when the engine rpm is increased, the latest sampled value $P_{BAn}$ becomes slightly small. On the other hand, if the count number $M_e$ becomes large, that is when the engine rpm is reduced, the latest sampled value becomes slightly large. Thus the correction operation according to the equation (2) may provide over correction. Therefore, by using the correction coefficient $\alpha(\gamma<1)$ the equation (2) can be rewritten as the following equation (3):

$$\begin{aligned} P_{BA} &= (1-\alpha)P_{BAn} + \alpha P_{BAn}(1/M_{eIDLE}) \cdot M_e \\ &= P_{BAn}\left\{1+\alpha\left(\frac{1}{M_{eIDLE}}M_e - 1\right)\right\} \\ &= P_{BAn}\{1+\alpha(M_e-1)\} \end{aligned} \tag{3}$$

In this way, the latest sampled value $P_{BAn}$ can be corrected in such a manner that the corrected value $P_{BA}$ is located on the solid line of FIG. 1.

In addition, in the system and method for controlling the fuel supply according to the present invention there is a tendency that the phase of the supply of the fuel becomes advanced relative to the supply of the air into the cylinders of the engine. Therefore, when the engine rpm becomes low, the air/fuel ratio of the mixture become rich and the air/fuel ratio becomes lean when the engine rpm becomes high.

Figure 5:
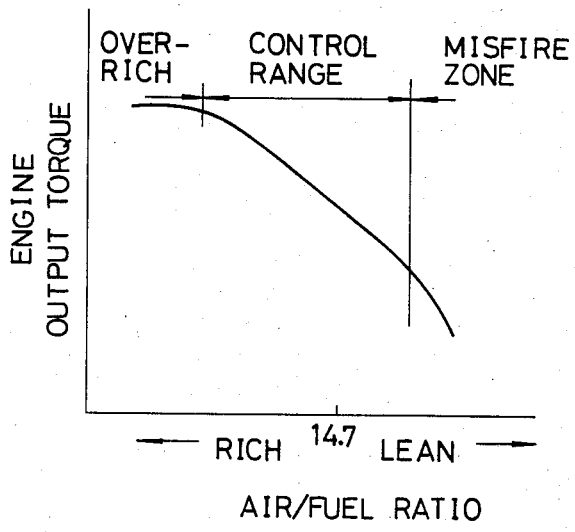
FIG. 5 is a diagram illustrating a relationship between the air/fuel ratio and engine output torque.

Accordingly, the range where the engine output is controlled in terms of the air/fuel ratio is limited as shown in FIG. 5 and the upper limit value HGRD and the lower limit value LGRD are provided.

Thus, according to the present invention, the detected value of the pressure within the intake pipe is corrected by the engine rpm and the corrected value of the pressure within the air intake pipe varies following the variation of the engine rpm so that it is located almost on the solid line of FIG. 1.

Therefore, if the amount of the fuel supply is determined according to the corrected value of the pressure within the air intake pipe, then the delay of the phase of recovering torque of the engine relative to the variation of the engine rpm is reduced even if the capacity of the intake pipe is large, and the engine rpm during the idling condition is stabilized and the driveability of the engine is improved.

What is claimed is:

1. A method for controlling fuel supply of an internal combustion engine having a throttle valve, according to a pressure within an intake pipe, downstream of the throttle valve, comprising the sequential steps of:

sampling said pressure within the intake pipe and a value corresponding to engine rotational speed at predetermined time intervals;

correcting a latest sample value $P_{BAn}$ of said pressure within the intake pipe by a ratio between a latest sampled value $M_{en}$ corresponding to engine rotational speed and a value corresponding to a predetermined idle speed of the engine, to produce a corrected value $P_{BA}$; and determining fuel supply amount according to said corrected value $P_{BA}$.

2. A method as claimed in claim 1, wherein said value corresponding to engine rotational speed is an inverted value of the engine rotational speed, and said correcting step comprises the sequential steps of:

dividing said sampled value Men of the inverted value of the engine rotational speed by an inverted value $M_{eIDLE}$ of a predetermined idling speed of the engine and substracting a value 1 from the quotient, to produce a value $M_{en}/M_{eIDLE}-1$;

multiplying a predetermined correction coefficient $\alpha$ representative of a degree of correction to said value of $M_{en}/M_{eIDLE}-1$ and adding a value 1 to the product, to produce a value $\alpha(M_{en}/M_{eIDLE}-1)+1$; and multiplying said latest sampled value $P_{BAn}$ of the pressure within the intake pipe with said value of $\alpha(M_{en}/M_{eIDLE}-1)+1$, to produce said corrected value $P_{BA}$.

* * * * *